US005764040A

United States Patent [19]

Miller

[11] Patent Number: 5,764,040

[45] Date of Patent: Jun. 9, 1998

[54] TRANSIENT TOLERANT POWER SUPPLY METHOD AND APPARATUS

[75] Inventor: Dennis J. Miller, Sherwood, Oreg.

[73] Assignee: Intel Corporation, Santa Clara, Calif.

[21] Appl. No.: 719,285

[22] Filed: Sep. 24, 1996

[51] Int. Cl.[6] ..... G05F 1/56

[52] U.S. Cl. ..... 323/282

[58] Field of Search ..... 323/266, 282, 323/285, 286, 287; 361/18, 111

[56] References Cited

U.S. PATENT DOCUMENTS

| | | | |
|---|---|---|---|
| 4,008,418 | 2/1977 | Murphy | 361/18 |
| 4,013,939 | 3/1977 | Biess | 323/17 |
| 5,157,353 | 10/1992 | Lendaro | 323/297 |
| 5,557,193 | 9/1996 | Kajimoto | 323/282 |
| 5,589,759 | 12/1996 | Borgato et al. | 323/222 |

*Primary Examiner*—Matthew V. Nguyen

*Attorney, Agent, or Firm*—Blakely, Sokoloff, Taylor & Zafman

[57] ABSTRACT

An apparatus for supplying power to a load having a plurality of power requirements, including normal power requirements and transient power requirements, the apparatus comprising a switching regulator that satisfies the normal power requirements of the load, and an amplifier that supplements the regulator output of the switching regulator, to satisfy the transient power requirements of the load. The switching regulator circuit being less responsive to high frequency changes in the power requirement of the load, while the amplifier being less responsive to low frequency changes in the power requirements of the load. The combination of the switching regulator and the amplifier resulting in a transient tolerant apparatus for the supply of power to a dynamic load.

15 Claims, 5 Drawing Sheets

TRANSIENT TOLERANT POWER SUPPLY METHOD AND APPARATUS

BACKGROUND

1. Field of the Invention

The present invention relates to the field of power supplies and, in particular, to a transient tolerant power supply method and apparatus.

2. Background Information

Evidence of technological evolution are ever present, with cellular telephones that fit in a shirt pocket, computers that fit in the palm of a hand, and microprocessor speeds surpassing 200 MHz. Despite the improvements made in technology, the power supply arts have remained relatively unchanged for the last several years. Personal computers, for example, still have the same bulky power supplies that were used several years ago.

Power supplies are typically comprised of two or three elements: a power regulation device, an energy storage device and, depending upon the application, a magnetic device. The magnetic device, such as a transformer, is required when the power source needs to be isolated from the object to which power is to be supplied (hereinafter referred to as the "load").

In general, there are two types of power regulation devices: digital regulators and analog regulators. Analog regulator circuits are comprised of power transistors, power diodes, filters and heat sinks. From a performance standpoint, analog regulators are characterized by having a relatively good frequency response with relatively poor efficiency, most of the power loss associated with the poor efficiency being converted into heat. As a result of this heat dissapation, power supplies incorporating analog regulators typically require large heat sinks, which take up an innordinate amount of space—a valuable commodity for many electronics designers—with little useful function other than heat dissapation. It is the space requirement associated with analog regulators that led to the development of the digital switching regulator.

Simplistically, the switching regulator, as its name implies, switches a power transistor between the saturation range and off (i.e., "on and off") in rapid succession to supply a regulated output. The switching characteristic of the switching regulator results in substantially improved efficiency when compared to the analog regulators, with lower heat dissapation. As a result of the increased efficiency, a power supply incorporating a switching regulator may not require the bulky heat sinks essential to the operation of analog regulators. While the switching nature of the switching regulator results in improved efficiency characteristics, it has an adverse affect on how responsive the regulator will be to changes in the power requirements of the load.

Switching regulators are inherently bandwidth limited to the frequency at which they switch "on and off". In general, switching regulators have a bandwidth of less than ten kilohertz (10 kHz), thus, if the load coupled to the power supply has a transient power requirement incurred in less than one tenth of a millisecond, the switching regulator will not be able to respond with adequate power to meet the transient power requirement of the load.

A prior art solution to the bandwidth limitation of the switching regulator was to place large amounts of capacitance (i.e., the energy storage device) at the power supply output, often in the form of large electrolytic capacitors, or even battery cells. The addition of the capacitors were intended to store sufficient power to satisfy the transient power requirements of the load. However, the space gained by eliminating the heat sinks associated with the analog regulators were merely replaced by several hundred microfarads of bulky electrolytic capacitors required to satisfy the transient power requirements of the load. As with the heat sinks, the space associated with the electrolytic capacitors is space that manufacturers of electronics can ill afford.

Thus a need exists for a transient tolerant power supply method and apparatus which eliminates the need for heat sinks and substantially reduces the amount of capacitance required to meet the transient power requirements of a given load.

SUMMARY OF THE INVENTION

In accordance with the teachings of the present invention, a transient tolerant power supply method and apparatus is disclosed. As illustrated in a first embodiment, an apparatus for supplying power to a load having a plurality of power requirements including normal power requirements and transient power requirements is described, the apparatus comprising a switching regulator for satisfying the normal power requirements of the load, coupled in parallel with an amplifier for satisfying the transient power requirements of the load.

The switching regulator exhibits an inverse frequency response characteristic, being responsive to low frequency changes in the power requirements of the load and decreasingly responsive to higher frequency changes in the power requirements of the load. Conversely, the amplifier exhibits a non-linear frequency response characteristic, being relatively unresponsive to low frequency changes in the power requirements of the load, and increasingly responsive to higher frequency changes in the power requirements of the load. Also, the amplifier has a gain characteristic proportional to the difference between the switching regulator output and the transient power requirements of the load. The result of coupling the regulator and amplifier in parallel is a complementary service of power to the load, wherein as a power transient is incurred by the power supply, the amplifier responds nearly instantaneously to satisfy the transient power requirements of the load; and, while the switching regulator output is increased to satisfy the transient power requirements, the output of the amplifier is decreased accordingly. As such, a low capacitance, transient tolerant power supply apparatus is described.

In an alternative embodiment, a transient tolerant power supply method is disclosed, in accordance with the teachings of the present invention. In particular, a method for supplying power to a load, the load having a plurality of power requirements including normal power requirements and transient power requirements is disclosed, the method comprising the steps of supplying a first power from a first source to satisfy the normal power requirements of the load and monitoring the power requirements of the load for transient power requirements. In the instance where transient power requirements are incurred, the first power is amplified by a second source to produce a second power, complementary to the first power and satisfying the transient power requirements of the load. As such, a transient tolerant method of supplying power to a load having a plurality of power requirements is disclosed.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following description, for purposes of explanation, specific numbers, materials and configurations are set forth in order to provide a thorough understanding of the present invention. However, it will be apparent to one skilled in the art that the present invention may be practiced without the specific details. In other instances, well known features are omitted or simplified in order not to obscure the present invention.

Figure 1:
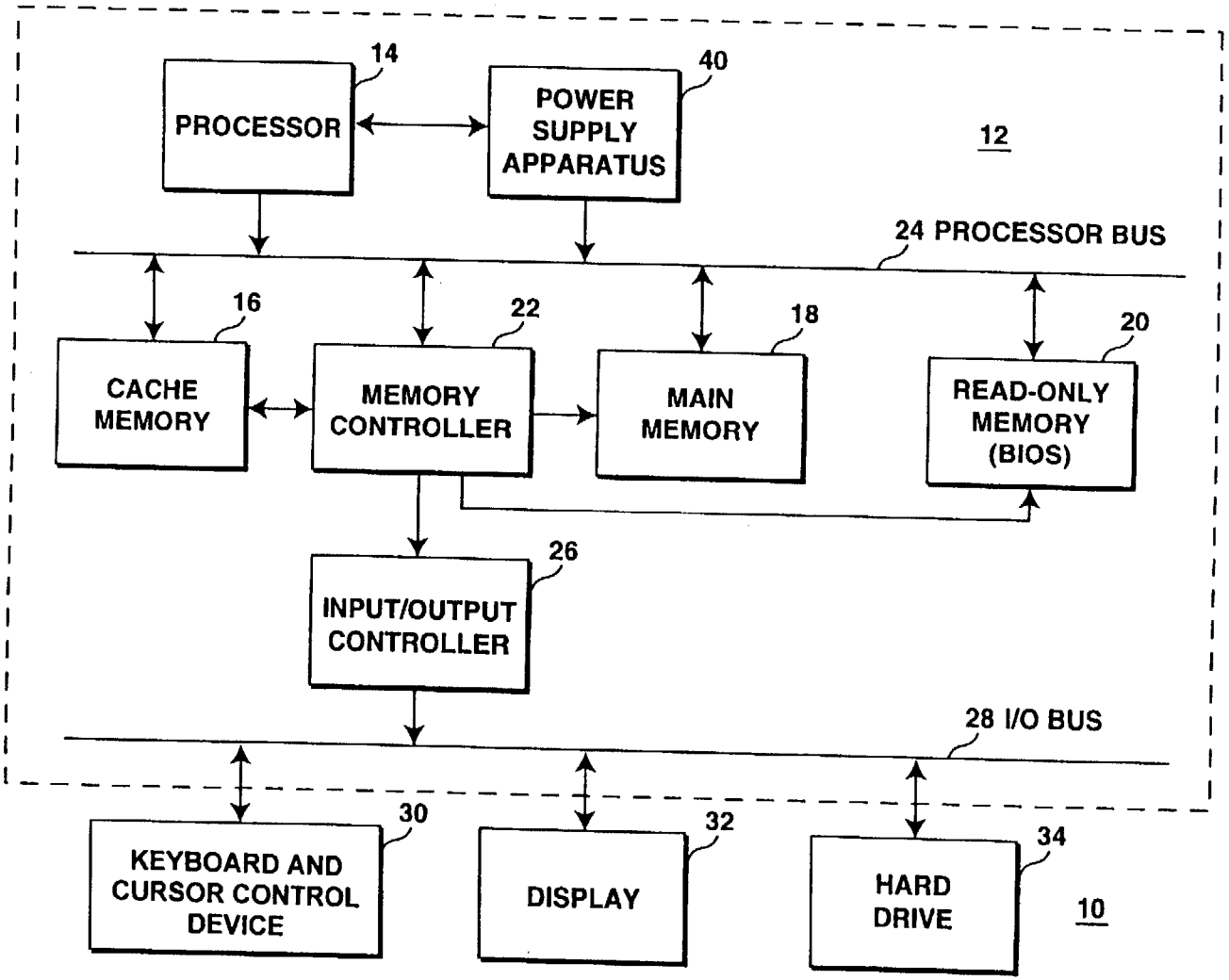
FIG. 1 illustrates a block diagram of an exemplary computer system suitable for incorporating the teachings of the present invention.

Referring now to FIG. 1, a block diagram illustrating an exemplary computer system 10 incorporating the teachings of the present invention is shown. Exemplary computer system 10 includes processor 14, cache memory 16, main memory 18, read-only memory 20, memory controller 22, power supply 40 and processor bus 24 coupled to each other as illustrated. Additionally, computer system 10 includes an input and output (I/O) controller 26, an I/O bus 28, keyboard and cursor control device 30, display 32, and hard drive 34 coupled to each other and the above enumerated elements as depicted. As illustrated, elements 14–28 and 40 are disposed on a printed circuit board assembly (e.g., motherboard) 12. While power supply 40 may be disposed on motherboard 12, it is not essential to its operation and may, therefore, be incorporated into computer system 10 as a separate subassembly. Finally, elements 12–34 perform their respective conventional function as known in the art, and may be implemented in any of a number of conventional techniques known to those skilled in the art. In fact, exemplary computer system 10 is intended to represent a broad category of computer systems.

Figure 2:
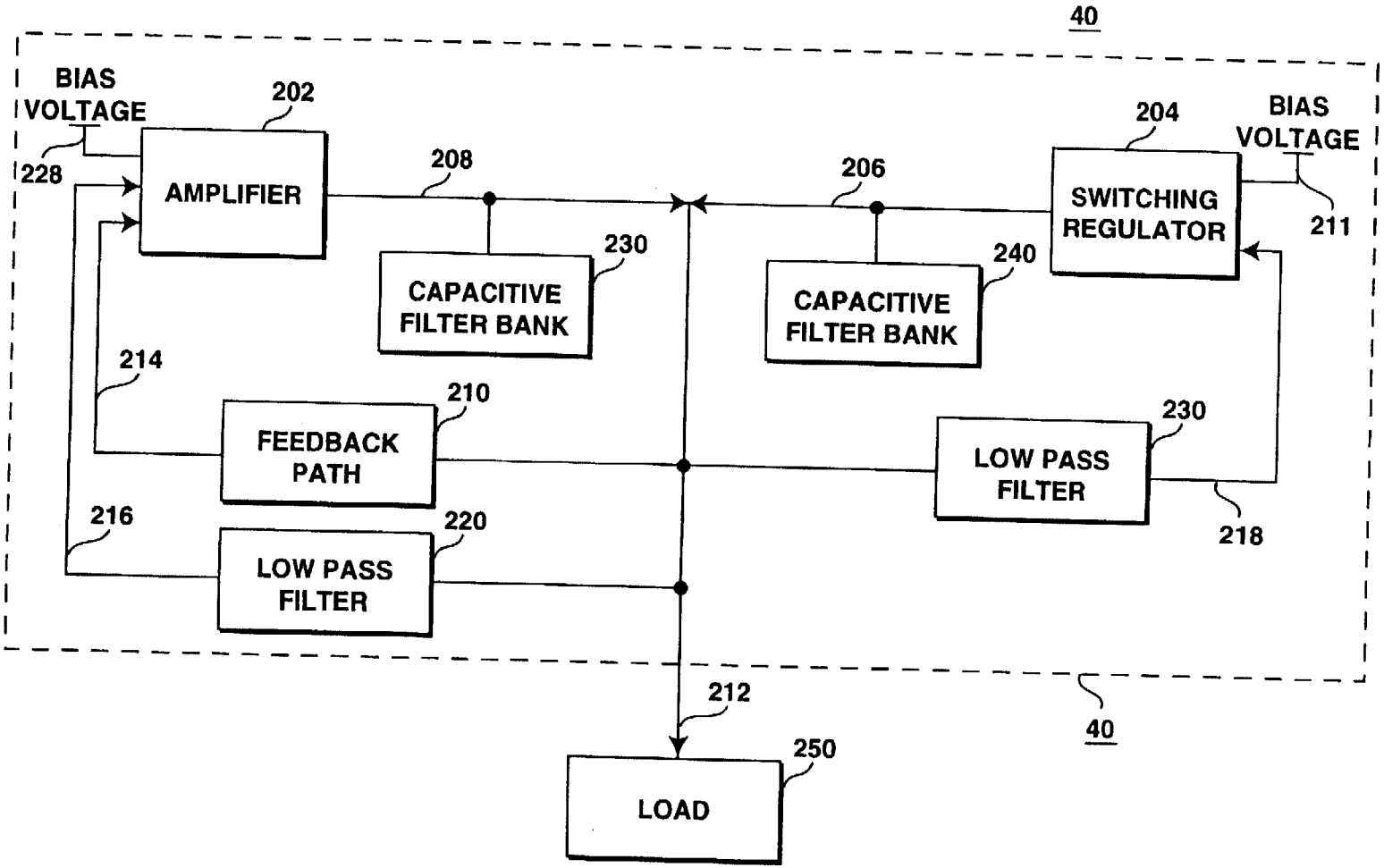
FIG. 2 illustrates a block diagram of a low capacitance, transient tolerant power supply apparatus suitable for incorporation in the exemplary computer system of FIG. 1.

FIG. 2 illustrates a block diagram of a low capacitance, transient tolerant power supply apparatus in accordance with the teachings of the present invention and suitable for implementation in the exemplary computer system of FIG. 1. In general, power supply 40 includes switching regulator 204, low pass filters 230 and 220, feedback path 210, amplifier 202, nominal output capacitance 280 and 240 each coupled together as depicted, to satisfy the plurality of power requirements of load 250.

As shown, switching regulator 204 receives input from bias voltage source 211 and low pass filter 230, the output power generated is supplied via regulator output 206. Similarly, amplifier 202 receives input from bias voltage 228 and feedback path 210 and low pass filter 220, the amplified power supplied via amplifier output 208. The regulator output 206 is coupled in parallel to the amplifier output 208 at the supply output 212. The supply output 212 is coupled to nominal capacitor bank 280 and 240, which serves as a low pass filter between power supply 40 and load 250. As depicted, feedback path 210 and low pass filters 220 and 230 each receive their respective input from supply output 212, as shown.

During operation, switching regulator 204 supplies substantially all of power required during normal load conditions. Switching regulator 204 receives feedback from output 212, filtered through low pass filter 230, which allows the switching regulator to respond to nominal load fluctuations, yet filters out high frequency transients. Amplifier 202 is incorporated into power supply 40 to supply power during the transient power requirements of the load to which switching regulator 204 cannot respond fast enough. By receiving feedback bias from output 212 through feedback path 210, amplifier 202 is isolated from the steady state load requirements, responding only to higher frequency transient power requirements.

The frequency response and gain characteristics of amplifier 202 obviate the need for the large capacitance requirement of prior art systems and, as it only handles short term transient power requirements, bulky heat sinks are not required. Although individually amplifier 202 and switching regulator 204 exhibit the limitations associated with the prior art, the innovative combination of the components in a complementary fashion, wherein the benefits of one compensate for the limitations of the other, an efficient, low capacitance yet transient tolerant power supply apparatus is described.

Figure 3:
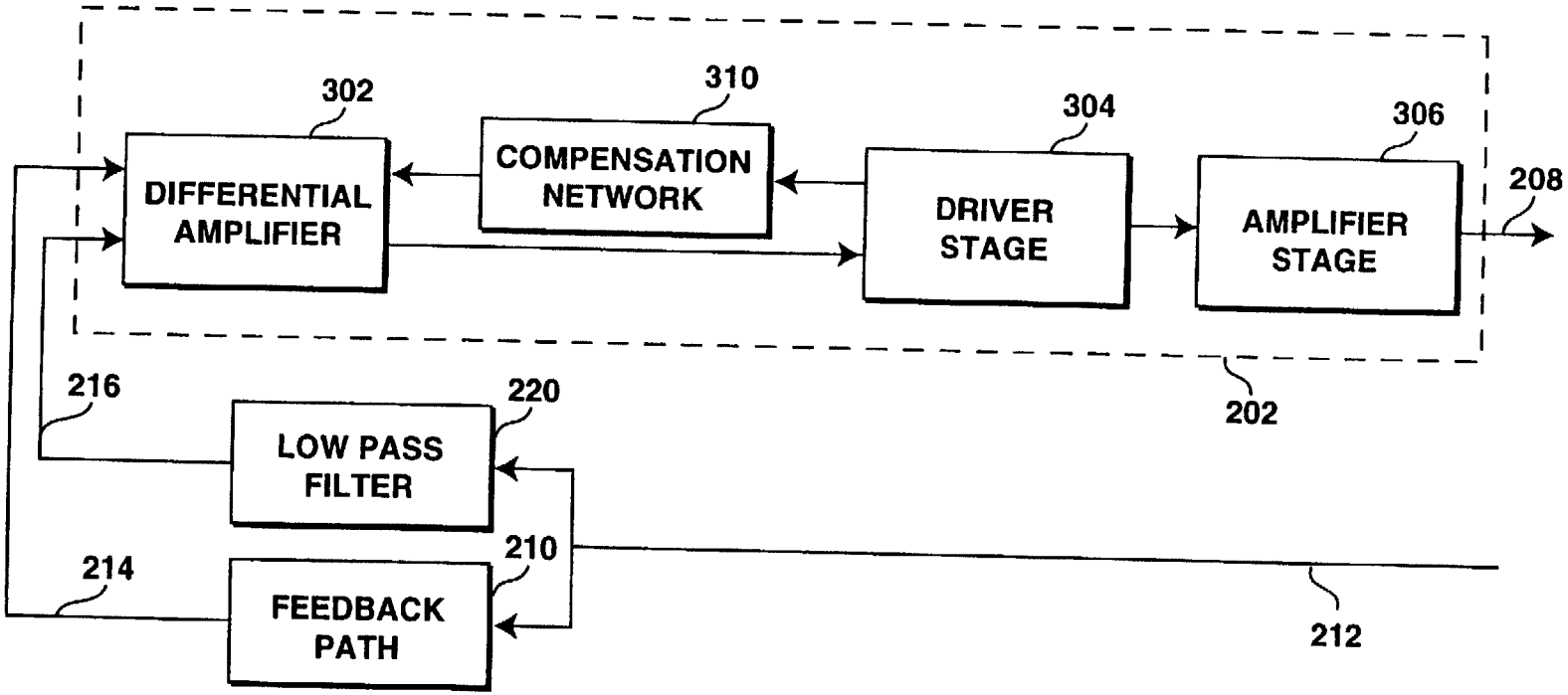
FIG. 3 illustrates a block diagram of an amplifier suitable for incorporation in the low capacitance, transient tolerant power supply apparatus of FIG. 2.

Turning to FIG. 3, a block diagram of an analog amplifier circuit, suitable for incorporation in the power supply apparatus of FIG. 2 is illustrated. As shown, amplifier 202 is comprised of a differential amplifier 302, a driver stage 304, and an amplifier stage 306 all coupled as depicted. As illustrated, differential amplifier 302 compares the signal from apparatus output 212 via feedback path 210, with the signal from apparatus output 212 filtered through low pass filter 220. The differential amplifier 302 produces voltage proportional to the difference between the signal 216 from low pass filter 220 and the signal 214 from feedback path 210. The differential amplifier 302 output provides signal input for driver stage 304. Accordingly, driver stage 304 drives the power transistors of the amplifier stage 306. Compensation network 310 serves to stabilize operation of the apparatus when various stages 202, 210 and 212 are joined together in a closed loop, filtering out undesirable transients associated with closed loop amplifier design. Finally, amplifier output 208 is driven by amplifier stage 306 in accordance with the characteristics identified above.

Figure 4:
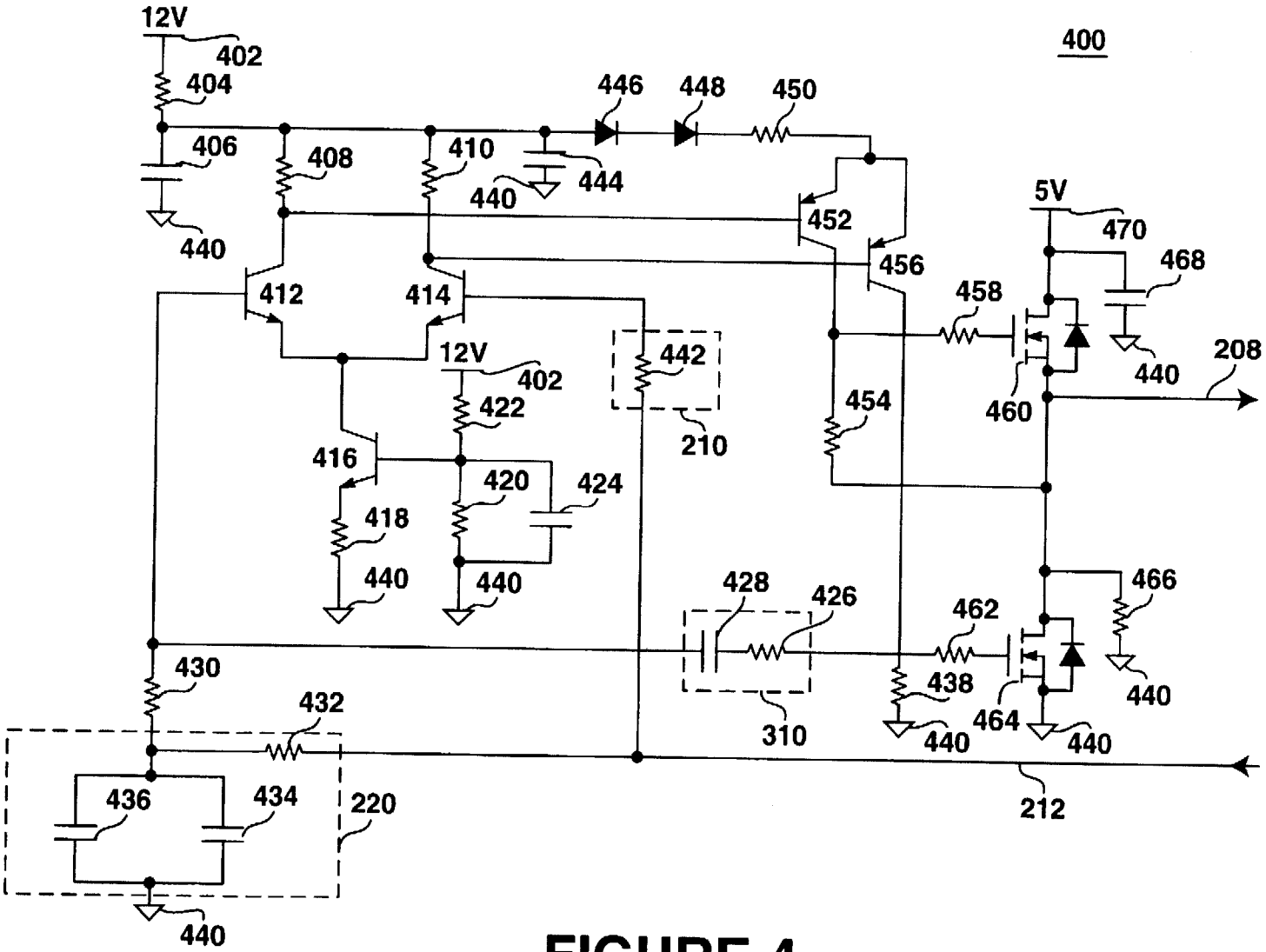
FIG. 4 illustrates a schematic diagram of an amplifier suitable for incorporation in the amplifier of FIG. 3.

FIG. 4 illustrates a schematic diagram of but one example of an amplifier 202 in accordance with the teachings of the present invention and suitable for incorporation in exemplary power supply 40 of FIG. 1. As illustrated in this example, amplifier 202 is appropriately biased with 12 volt source 402 and 5 volt source 470, and is properly grounded at ground plane 440. Differential amplifier 302 is comprised of three bipolar junction transistors (BJTs) 412, 414 and 416, biasing resistors 408, 410, 418, 420, 422 and 430, capacitor 424 and a low pass filter comprised of resister 404 and capacitors 406 and 444. The driver stage 304 is comprised of two BJTs 452 and 456, a pair of diodes 446 and 448, and resistors 438, 450, 454, 458 and 462. The amplifier stage 306 is comprised of two field effect transistors (FETs) 460 and 464, resistor 466, and filter capacitor 468. Low pass filter 220 is comprised of resistor 432 and parallel capacitor pair 434 and 436. Compensation network 310 consists of blocking capacitor 428 and resistor 426. The feedback path 210 is comprised of resistor 442.

In the preferred embodiment, switching regulator 204 may be any typical switching regulator circuit providing the appropriate power handling capability. The part number of the field effect transistors of the amplifier stage 306 of the preferred embodiment is "IRFZ44NS", commonly available from International Rectifier of El Segundo, Calif. One skilled in the art will appreciate, however, that although a specific part number has been identified, these are but examples of suitable components. Individual components may be changed without departing from the scope or spirit of the teachings of the present invention.

While the use of particular components is merely illustrative, the complementary design characteristics give rise to the novel performance characteristics of the power supply. Individually, the amplifier has a non-linear frequency response characteristic, wherein the amplifier is generally unresponsive to the slowly changing power requirements of the load (normal power requirements), yet very responsive to high frequency changes in the power requirements of the load (transient power requirements). The output characteristic of the amplifier is characterized as being proportional to the difference between the average amplitude of the switching regulator output and the amplitude of the power requirements of the load. Accordingly, the amplifier, as designed, will not contribute to the supply of normal power requirements, and will be fairly unresponsive to low frequency changes in the power requirements of the load. As transient power requirements are incurred, however, the amplifier is very responsive to respond with the gain required to satisfy the transient load requirements. These characteristics are beneficially employed by the supply in that whereas the amplifier will be essentially "off" during the normal power requirements of the load, it does not require the addition of heat sinks to dissipate heat.

Conversely, the switching regulator is characterized by an inverse frequency response characteristic, wherein the ability of the regulator to respond to changes in power requirements diminishes with increased frequency. As discussed above, the frequency response of the switching regulator is inherently limited by the frequency at which it switches the power transistor between its saturation range and off. As the switching regulator reaches the upper limit of its frequency response, the amplifier is actuated to supplement the output of the switching regulator until the switching regulator can "catch up" and meet the power requirements of the load.

Figure 5:
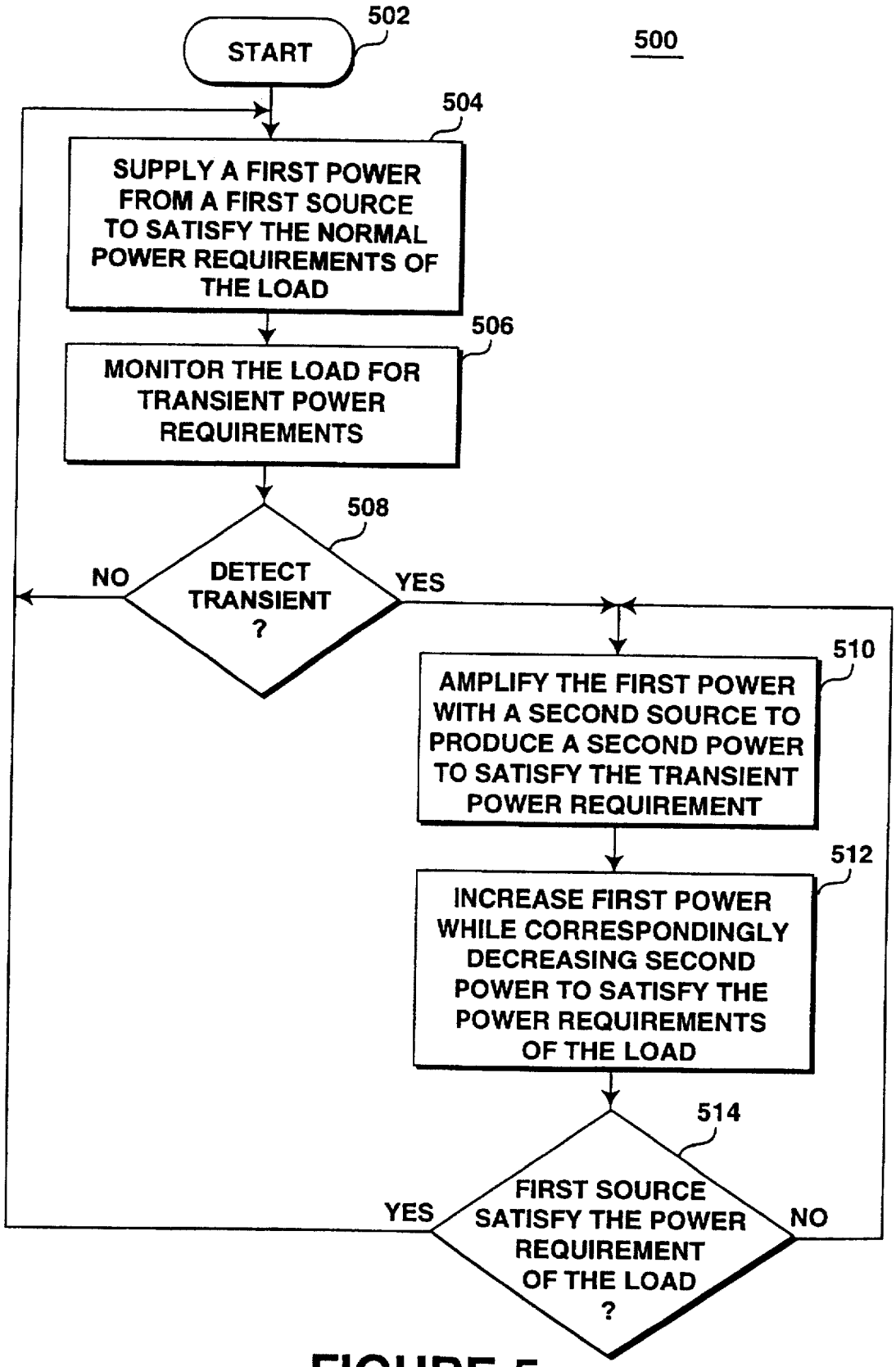
FIG. 5 illustrates a block diagram of a transient tolerant power supply method in accordance with the teachings of the present invention.

Turning to FIG. 5, a flow chart representation of a method for supplying power to a load which is tolerant of transient fluctuations in the load requirement. As depicted, method 500 begins with step 502 wherein the system is required to satisfy the power requirements of a load, including normal power requirements and transient power requirements. In step 504, a first source supplies a first power to satisfy the normal power requirements of the load. In step 506, the system monitors the load for transient power requirements. In step 508, a determination is made based on the monitoring, whether a transient has been detected. If no transients are detected, method 500 loops back to step 504 and the system continues to supply power to the load via the first source.

If, however, the system detects a transient power requirement in step 508, a second source amplifies the first power of the first source, in step 510, to satisfy the transient power requirements of the load. As soon as the transient power requirement is detected in step 508, the second source is activated to amplify the output of the first source to satisfy the power requirement of the load, and the first source immediately begins to increase its output power to satisfy the transient power requirement, in step 512. Further in step 512, as the first source is increasing its output power, the need for the second source to amplify the first power is diminished. Accordingly, as the first source increases its output power, the second source amplifier gain is correspondingly reduced to satisfy the power requirements of the load. Finally, in step 514, a determination is made as to whether the first source is satisfying the power requirements of the load.

If the transient condition has passed, or the first source has increased its power output to satisfy the increased demand, the second source is taken out of the loop and method 500 loops back to its quiescent state in step 504. If, alternatively, it is determined that the first source is not yet satisfying the power requirements of the load, in step 514, the amplifier continues to augment the first power and method 500 loops back to step 510.

Thus, a transient tolerant power supply apparatus and method has been described. While the method and apparatus of the present invention has been described in terms of the above illustrated embodiments, those skilled in the art will recognize that the invention is not limited to the embodiments described. Thus, the present invention can be practiced with modification and alteration within the spirit and scope of the appended claims. Accordingly, the description is to be regarded as illustrative instead of restrictive on the present invention.

What is claimed is:

1. An apparatus for supplying power to a load having a plurality of power requirements including normal power requirements and transient power requirements, the apparatus comprising:

a switching regulator circuit having a regulator output for supplying power to the load during normal power requirements; and an analog amplifier circuit having an amplifier output coupled to the regulator output, for jointly supplying power to the load in conjunction with the regulator circuit during transient power requirements.

2. The apparatus of claim 1, wherein the switching regulator circuit and the analog amplifier circuit are responsive to changing load requirements through feedback filter networks.

3. The apparatus of claim 1, wherein the analog amplifier circuit is less responsive to low frequency changes in power requirements, and more responsive to higher frequency changes in power requirements of the load.

4. The apparatus of claim 1, wherein the switching regulator circuit is more responsive to low frequency changes in power requirements, and less responsive to higher frequency changes in power requirements of the load.

5. The apparatus of claim 1, wherein the analog amplifier has a gain that is proportional to the difference between the power requirement of the load and the output power of the switching regulator circuit.

6. The apparatus of claim 1, wherein the analog amplifier circuit has an output characteristic that diminishes as the switching regulator circuit increases power output to satisfy the transient power requirements of the load.

7. The apparatus of claim 1, wherein the analog amplifier has a gain characteristic that is inversely proportional to the frequency response of the switching regulator.

8. A computer system comprising:

a switching regulator circuit having a regulator output operative to supply power to the system to satisfy normal power requirements of the system;

an amplifier having an amplifier output, coupled to the regulator output, and operative to provide supplementary power, the combination of the regulator output and the amplifier output being sufficient to satisfy transient power requirements of the system.

9. The computer system of claim 8, wherein the switching regulator circuit and the amplifier are responsive to changes in load power requirements.

10. The computer system of claim 8, wherein the amplifier is less responsive to low frequency changes in load power requirements, and more responsive to high frequency changes in load power requirements.

11. The computer system of claim 8, wherein the switching regulator circuit is more responsive to low frequency changes in load power requirements, and less responsive to higher frequency changes in load power requirements.

12. The computer system of claim 8, wherein the amplifier has a gain characteristic that is proportional to a difference between the regulator output of the switching regulator circuit and the load power requirements.

13. The computer system of claim 8, wherein as the regulator output of the switching regulator is increased to meet the transient power requirements, the output of the amplifier is correspondingly diminished in response to the switching regulator.

14. A method for supplying power to a load having a plurality of power requirements including normal power requirements and transient power requirements, the method comprising the steps of:

(a) supplying power from a first source satisfying the normal power requirements of the load;

(b) monitoring the load to detect transient power requirements; and (c) amplifying the power supplied from the first source with a second source to produce supplemental power to satisfy transient power requirements detected during said step of monitoring.

15. The method of claim 14, further comprising the steps of:

(d) increasing the power supplied from the first source to satisfy transient power requirements detected during said step of monitoring; and (e) concurrently decreasing the supplemental power in response to and in proportion to increasing the power supplied from the first source.

* * * * *